US005603540A

United States Patent [19]

Shibao

[11] Patent Number: 5,603,540

[45] Date of Patent: Feb. 18, 1997

[54] SWING LID LOCKING MECHANISM

[75] Inventor: Masaharu Shibao, Sagamihara, Japan

[73] Assignee: Nifco, Inc., Kanagawa, Japan

[21] Appl. No.: 572,043

[22] Filed: Dec. 14, 1995

[30] Foreign Application Priority Data

Dec. 28, 1994 [JP] Japan ..... 6-340012

[51] Int. Cl.[6] ..... B05B 15/02

[52] U.S. Cl. ..... 292/341.15; 292/DIG. 17; 292/128; 292/DIG. 22

[58] Field of Search ..... 292/341.15, 341.17, 292/344, DIG. 11, 121, 163, 303, 148, DIG. 17, 128, DIG. 22

[56] References Cited

U.S. PATENT DOCUMENTS

| | | | |
|---|---|---|---|
| 3,102,708 | 9/1963 | Crain | 292/341.15 |
| 5,067,625 | 11/1991 | Numata | 220/343 |
| 5,149,153 | 9/1992 | Drewry et al. | 292/341.15 |
| 5,158,353 | 10/1992 | Kimisawa | 382/833 |
| 5,427,447 | 6/1995 | Satoh | 312/309 |
| 5,518,282 | 5/1996 | Sawada | 292/128 X |
| 5,520,313 | 5/1996 | Toshihide | 224/539 |

*Primary Examiner*—Rodney M. Lindsey
*Assistant Examiner*—Monica E. Millner
*Attorney, Agent, or Firm*—Sughrue, Mion, Zinn, Macpeak & Seas

[57] ABSTRACT

A swing lid locking mechanism prevents the lid of a container from accidentally opening when shocks act on the container. The swing lid locking mechanism comprises one of a pair of support legs formed integrally with the lid body of the lid and pivotally supported by support pins on the side wall of the container body, provided with a locking projection; and an impact locking device comprising a bottomed case provided with a longitudinal slot in one side wall thereof, a locking weight provided with a groove in an upper part of the outer side surface thereof across the width and a stopping projection in a middle part of the outer side surface, and axially slidably inserted in the case so that the stopping projection is received in the longitudinal slot of the bottomed case, and a spring compressed between the lower end of the locking weight and the bottom wall of the case. The bottomed case is attached to the outer surface of one side wall of the case body so that the front side of the locking weight is positioned behind and substantially contiguous with the first locking projection of the support leg at a position corresponding to the closed position of the lid of the container with the groove of the locking weight aligned with the locking projection of the support leg. The locking weight moves into the case by inertia when shocks act on the container.

4 Claims, 6 Drawing Sheets

SWING LID LOCKING MECHANISM

BACKGROUND OF THE INVENTION

1. Field of the Invention

The present invention relates to a swing lid locking mechanism for locking a swing lid for closing the open end of a container, such as a console installed on an automobile, and, more specifically, to a swing lid locking mechanism for locking the swing lid of a console to prevent the swing lid from accidental flapping due to shocks that act on the swing lid when the automobile collides against an obstacle, when the automobile is braked sharply or when the automobile travels on a rough road.

2. Description of the Related Art

FIGS. 8, 9A and 9B show a related art swing lid locking mechanism proposed in Japanese Utility Model Publication No. 5-47234 to prevent a swing lid for closing a container, such as a console installed in the passenger compartment of an automobile, from opening accidentally when shocks act on the container. Referring to FIG. 8, a swing lid b is supported pivotally at its rear part on an upper rear part of a container body a having the shape of a generally rectangular parallele-piped having an open upper end, the swing lid b is biased in an opening direction by a spring c, the swing lid b is latched at a closed position by a latching mechanism comprising a locking projection d projecting from the lower surface of the free end of the swing lid b, and a push-lock/push-unlock latch e attached to an upper front part of the container body a. The latch e catches the locking projection d to lock the swing lid b in place against the resilience of the spring c. A swing lid locking mechanism for preventing the swing lid b from accidental opening due to shocks comprises a stopper f supported on an upper front part of the container body a so as to project upward from the open upper end of the container body a, a sliding member g supported for sliding below the stopper f, a spring h biasing the stopper f upward, and a spring i biasing the sliding member g obliquely upward.

Referring to FIG. 9A, when a pressure p is applied to the free end of the swing lid b at a closed position to depress the swing lid b, the locking projection d is depressed in the latch e and is released from the latch e, so that the swing lid b is turned in an opening direction to an open position b' indicated by alternate long and short dash lines in FIG. 8 by the resilience of the spring c to open the open upper end of the container body a. When the free end of the swing lid b is depressed by the pressure p, the stopper f is depressed by the swing lid b against the spring h. Referring to FIG. 9B, when shocks act on the swing lid b due to the collision of the automobile against an obstacle or the sharp braking of the automobile, the sliding member g slides against the resilience of the spring i, and the locking part g' of the sliding member g moves underneath the stopper f. Consequently, the downward movement of the swing lid b is obstructed by the stopper f even if shocks attempt to depress the free end of the swing lid b, so that the locking projection d is not released from the latch e and the swing lid b is locked at its closed position.

This related art swing lid locking mechanism, however, has the following problems. First, the swing lid locking mechanism must be installed on the side of the free end of the swing lid b, and it is difficult to install the swing lid locking mechanism near the supported end of the swing lid b. The stopper f prevents the swing lid b from turning downward by a predetermine angular stroke necessary for the swing lid b to be unlocked. Since the linear stroke of a part of the swing lid b near the supported end corresponding to the predetermined angular stroke is very small, it is difficult to enable the stopper f to function effectively when the swing lid locking mechanism is installed near the supported end of the swing lid b. Therefore, this swing lid locking mechanism cannot be applied to locking the swing lid b when the structural requirements of the automobile require the swing lid locking mechanism to be installed near the supported end of the swing lid b.

Secondly, this related art swing lid locking mechanism is applicable only to a swing lid for a container employing a push-lock/push-unlock latch. Since the stopper f is in contact with the swing lid b to prevent the downward turning of the swing lid b that unlatches the swing lid b, this swing lid locking mechanism cannot be applied to locking a swing lid which is biased in a closing direction when the swing lid is turned near to a closed position to hold the swing lid at the closed position and biased in an opening direction when the swing lid is turned near to an open position to hold the swing lid at the open position.

Thirdly, this related art swing lid locking mechanism is only capable of holding the swing lid b at the closed position and is incapable of preventing the swing lid b at the open position from being suddenly turned by shocks in a closing direction to the closed position. Although the swing lid b at the open position is not closed perfectly by shocks and latched by the latch e because the stopper f is held at an upper position, there is the possibility that the swing lid b is slammed by shocks against the resilience of the spring c to catch fingers between the container body a and the swing lid b.

Fourthly, this related art swing lid b locking mechanism is unsatisfactory in an aesthetic point of view because the stopper f project upward from the open upper end of the container body a when the swing lid b is opened.

SUMMARY OF THE INVENTION

The present invention has been made in view of those problems in the prior art and it is therefore an object of the present invention to provide a swing lid locking mechanism for locking a swing lid, capable of being installed near the supported end of the swing lid, of locking a swing lid for closing the open end of a container not provided with any push-lock/push-unlock latch, of controlling the turning of a swing lid by shocks in both an opening direction and a closing direction, and of avoiding spoiling the aesthetic appearance of the container by a stopper or the like projecting from the open end of the container.

With the foregoing object in view, the present invention provides a swing lid locking mechanism for preventing a swing lid for closing the open end of a container from being accidentally opened or closed by shocks or the like, comprising: a pair of support legs attached to the lid body of the swing lid so as to project from the lid body and pivotally joined to the container body to enable the swing lid to turn, one of the pair of support legs being provided with a locking projection; a locking weight supported for sliding near the support leg provided with the locking projection; a biasing means for biasing the locking weight in one sliding direction. When shocks act on the container, the locking weight slides by inertia against the biasing force of the biasing means and engages with the locking projection to prevent the support leg from turning to prevent the turning of the swing lid, so that the swing lid is prevented from opening or closing by shocks.

The swing lid locking mechanism thus capable of preventing the swing lid from accidental opening or closing due to shocks is applied to a container or the like provided with a swing lid and installed in the passenger compartment of an automobile or the like to prevent the closed swing lid from turning in an opening direction or the open swing lid from turning in a closing direction due to shocks against the intention of the user. When the swing lid is turned to open or close the open end of the container, the support legs turn together with the swing lid. Under the normal condition, the locking weight is held at a retracted position by the biasing means so that the locking weight may not engage with the locking projection of the support leg and hence the swing lid can be turned freely for opening and closing. When shocks act on the container, the locking weight slides by inertia to a locking position against the biasing force of the biasing means and engages with the locking projection of the support leg to prevent the support leg fixed to the swing lid from turning, so that the open swing lid is unable to turn for closing and the closed swing lid is unable to turn for opening. When shocks are removed, the locking weight is caused to slide to the retracted position by the biasing means to enable the swing lid to be opened and closed freely.

Thus, the swing lid locking mechanism of the present invention locks the swing lid by the engagement of the locking projection of the support leg and the locking weight. Therefore, the swing lid locking mechanism is suitable for use in locking a swing lid when the structural requirements of the automobile require the swing lid locking mechanism to be installed near the supported end of the swing lid. Since none of the components of the swing lid locking mechanism is exposed in the open end of the container, the locking means does not spoil the aesthetic appearance of the container. Since the locking weight stops the supported end of the swing lid directly to prevent the swing lid from turning, the swing lid locking mechanism of the present invention is suitably applicable to locking the swing lid of a container not provided with any push-lock/push-unlock latch, such as a container provided with a mechanism for biasing the swing lid in a closing direction to hold the swing lid at the closed position when the swing lid is near the closed position and biasing the swing lid in an opening direction to hold the swing lid at the open position when the swing lid is near the open position. Since the locking weight engages directly with the locking projection of the support leg fixed to the swing lid to prevent the swing lid from turning, the angular position of the swing lid where the locking projection engages with the locking weight can be optionally determined by properly determining the position of the locking projection on the support leg to determine selectively the position of the swing lid where the swing lid is locked, i.e., either the closed position or the open position. The swing lid can be locked at both the closed position and the open position when the support leg is provided with two locking projections, i.e., a locking projection that engages with the locking weight when the swing lid is at the closed position and a locking projection that engages with the locking weight when the swing lid is at the open position.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
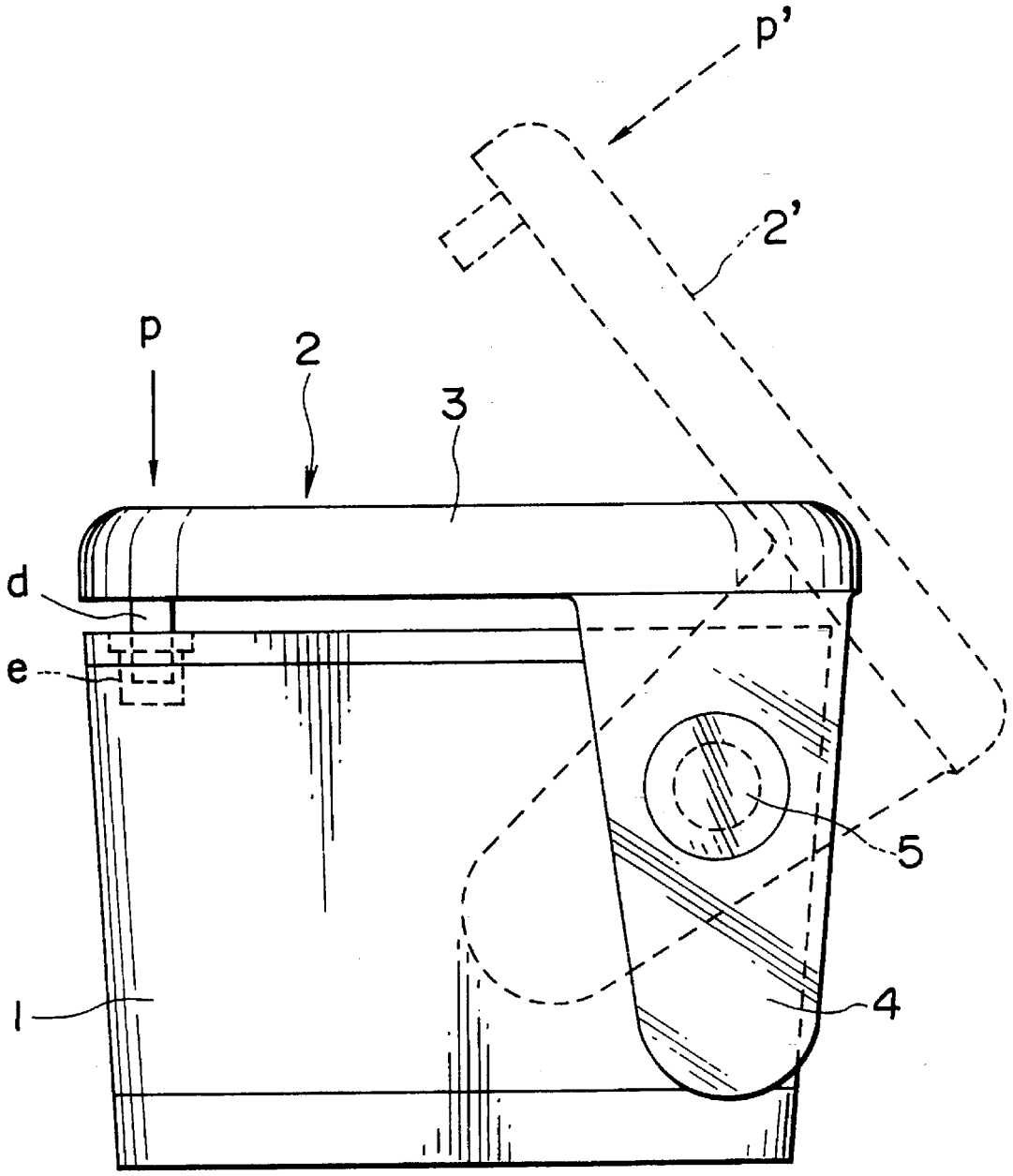
FIG. 1 is a side view of a container provided with a swing lid, and a swing lid locking mechanism in a preferred embodiment according to the present invention.

Referring to FIG. 1, a container comprises a container body 1 and a swing lid 2 for closing the open upper end of the container body 1. The container is used as a center console of an automobile or is incorporated into the dashboard of an automobile and used as a glove compartment. The swing lid 2 has a lid body 3, and a pair of support legs 4 formed integrally with the lid body 3 so as to project from the lower surface of the lid body 3 at the opposite sides of a rear part of the lid body 3. The support legs 4 (only one of them is shown in FIG. 1) are supported for turning by support pins 5 on rear parts of the opposite side walls of the container body 1. A lid locking projection d projects from the lower surface of the front end of the lid body 3, and a push-lock/push-unlock latch e is attached to an upper part of the front wall of the container body 1 to catch the lid locking projection d to lock the swing lid 2 at the closed position. The swing lid 2 is biased in a opening direction by a spring, not shown, interposed between the swing lid 2 and the container body 1. The push-lock/push-unlock latch e latches the lid locking projection d when the lid locking projection d is pushed therein for the first time and unlatches the lid locking projection d when the lid locking projection d latched thereby is pushed therein for the second time.

Figure 2:
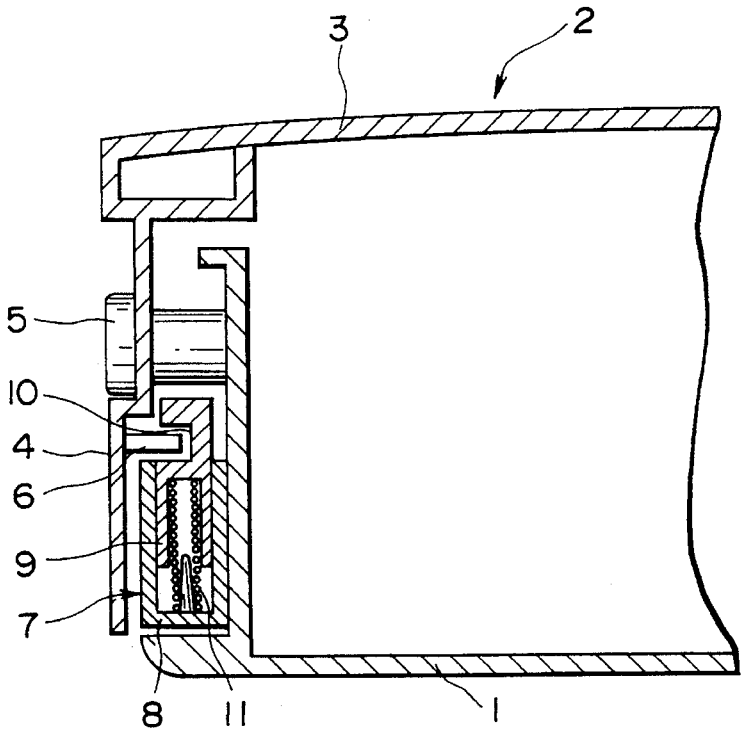
FIG. 2 is a fragmentary sectional view of the container of FIG. 1 in the normal state.
Figure 3:
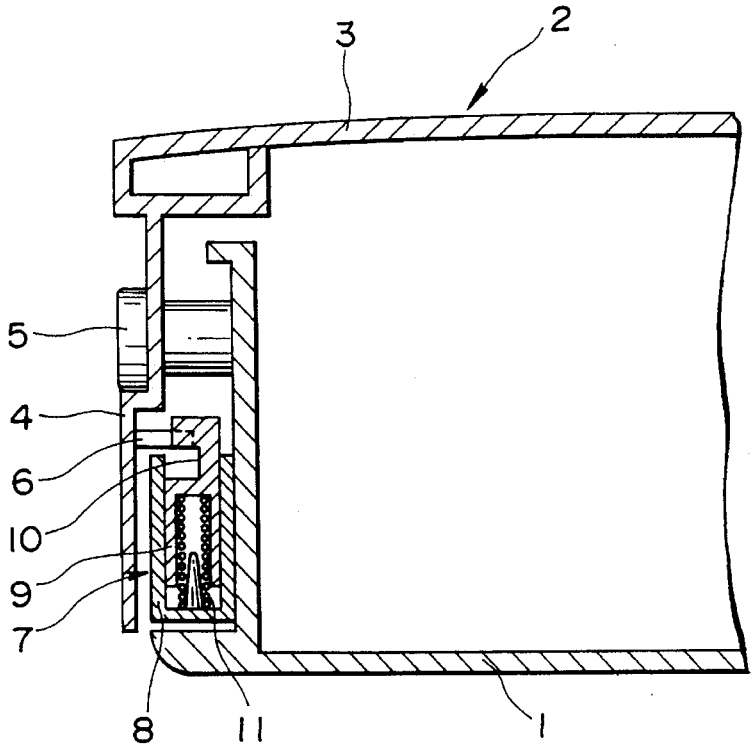
FIG. 3 is a fragmentary sectional view of the container of FIG. 1 in a state where shocks are exerted on the container and the swing lid locking mechanism is in a locking position.
Figure 4:
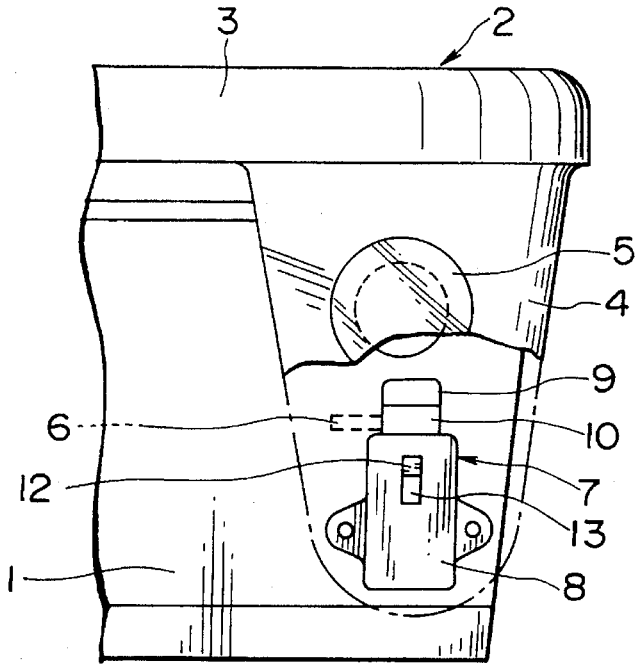
FIG. 4 is a fragmentary partly cutaway side view of the container of FIG. 1.
Figure 5:
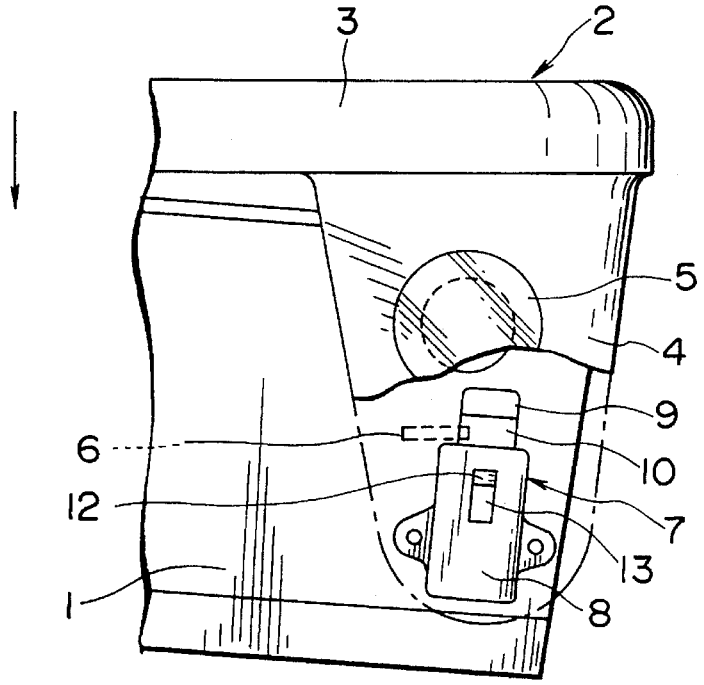
FIG. 5 is a fragmentary partly cutaway side view of the container of FIG. 1 in a state where the swing lid is able to open.
Figure 7:
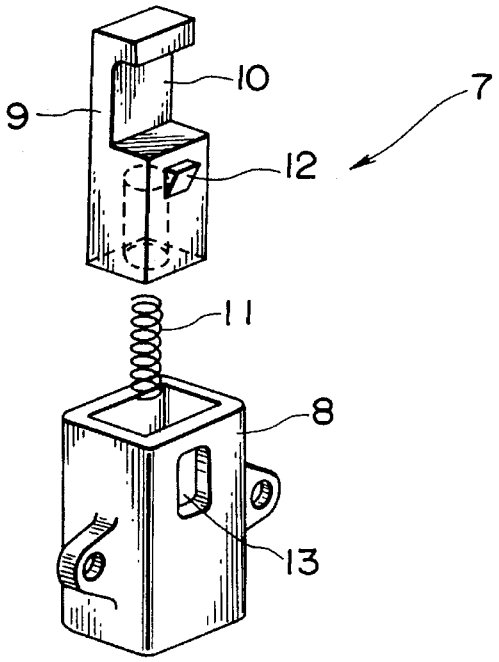
FIG. 7 is an exploded perspective view of an impact locking device included in the swing lid locking mechanism of the container of FIG. 1.
Figure 8:
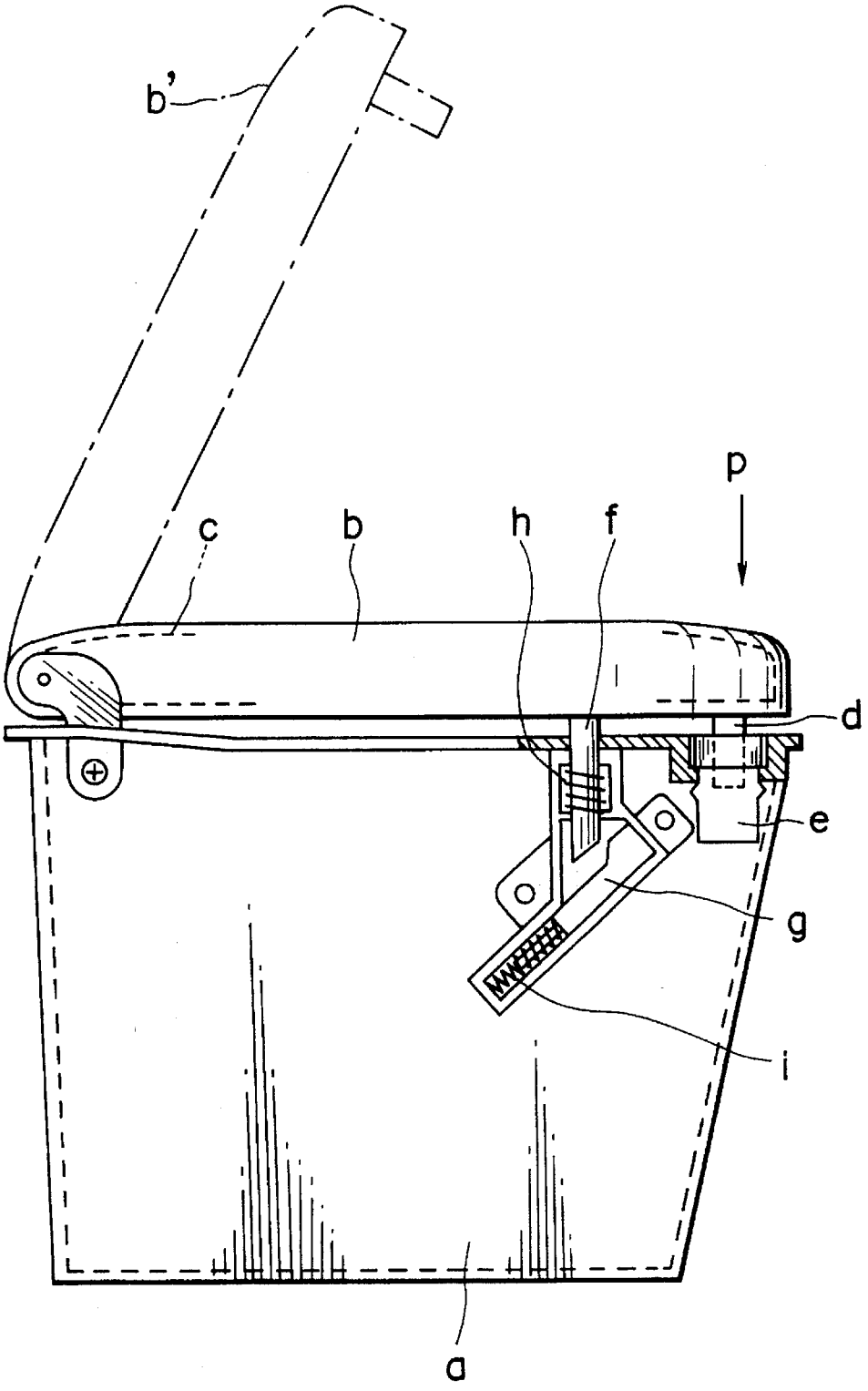
FIG.8 (PRIOR ART)
FIG. 8 is a partly sectional side view of a container provided with a swing lid, and a prior art swing lid locking mechanism.
Figure 9A:
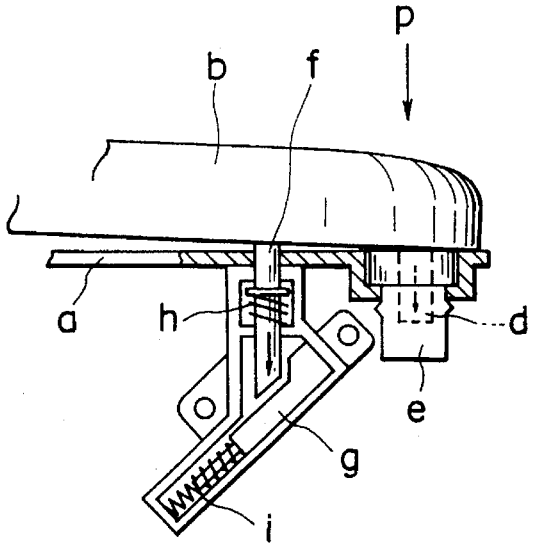
FIG.9(A) (PRIOR ART)
FIGS. 9A and 9B are sectional views of the swing lid locking mechanism of FIG. 8 in a state to unlock the swing lid and in a state to lock the swing lid, respectively.
Figure 9B:
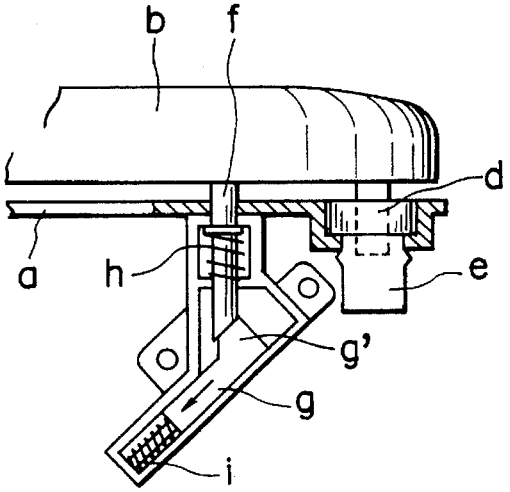
FIG.9(B) (PRIOR ART)

As shown in FIGS. 2 and 3, one of the pair of support legs 4 formed integrally with the lid body 3 of the swing lid 2 is provided with a locking projection 6 on its inner surface at a position on the front side of the support pin 5, and an impact locking device 7 is attached to the outer surface of a rear part of the side wall of the container body 1 between the swing leg 4 and the side wall of the container body 1. As shown in FIG. 7, the impact locking device 7 comprises a bottomed case 8 having the shape of a quadrangular cylinder and provided with a rectangular opening 13 in one side wall thereof, a locking weight 9 having the shape of a quadrangular prism, provided with a groove 10 in an upper part of one side surface thereof across the width and a stopping projection 12 in a middle part of the same side surface and axially slidably inserted in the case 8, and a compression coil spring 11 compressed between the lower end of the locking weight 9 and the bottom wall of the case 8 to bias the locking weight upward. When the locking weight 9 is inserted in the case 8, the stopping projection 12 of the locking weight 9 is received in the opening 13 of the case. The stopping projection 12 comes into engagement with the upper edge of the opening 13 as shown in FIGS. 4 and 5 to limit the upward movement of the locking weight 9 relative to the case 8. As shown in FIGS. 2 and 4, the locking weight 9 is at its uppermost position and near and behind the locking projection 6 with the groove 10 on the same level as the locking projection 6 of the support leg 4 when the swing lid 2 is closed and no shock is acting on the container.

As shown in FIG. 1, the lid locking projection d of the swing lid 2 is latched by the push-lock/push-unlock latch e attached to the container body 1 to hold the swing lid 2 at the closed position against the resilience of the spring, not shown, under normal conditions. When opening the swing lid 2 to open the open end of the container body 1, a pressure p is applied to the front end of the swing lid 2 to turn the swing lid 2 in the closing direction and to push the lid locking projection d further into the latch e. Consequently, the lid locking projection d is released from the latch e and, when the pressure p is removed from the swing lid 2, the spring, not shown, turns the swing lid 2 in the opening direction automatically to a position indicted by broken lines 2' in FIG. 1 to open the container body 1. When closing the swing lid 2, a pressure p' is applied to the swing lid 2 to turn the swing lid in the closing direction and to push the lid locking projection d into the latch e. Then, the latch e catches the lid locking projection d to hold the swing lid 2 at the closed position. When the swing lid 2 is turned for opening and closing together with the support legs 4 under normal conditions, the locking weight 9 of the impact locking device 7 is at its uppermost position with its groove 10 on the same level as the locking projection 6 of the support leg 4. When the pressure p is applied to the front end of the swing lid 2 to release the lid locking projection d from the latch e so that the swing lid 2 can be turned in the opening direction, the support legs 4 are able to turn in the closing direction and the locking projection 6 of the support leg 4 is able to go into the groove 10 of the locking weight 9 as shown in FIG. 5 to enable the latch e to release the lid locking projection d.

Figure 6:
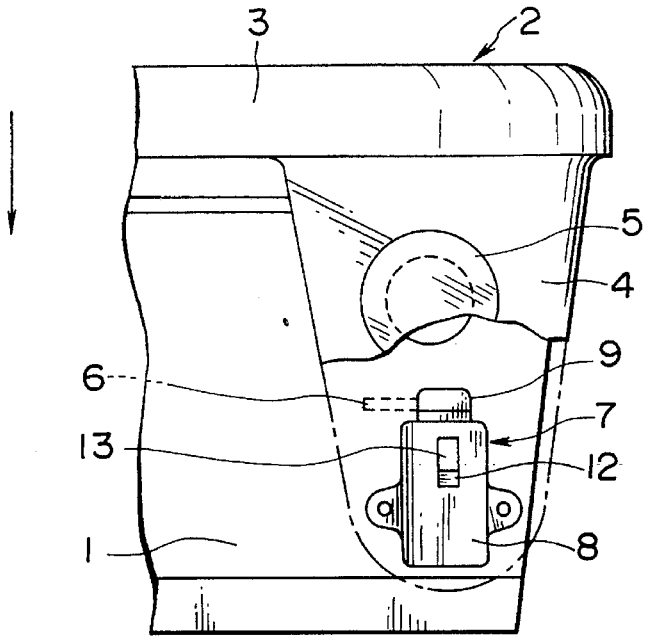
FIG. 6 is a fragmentary partly cutaway side view of the container of FIG. 1 in state where shocks are exerted on the container and the swing lid locking mechanism is in a locking position.

When shocks act on the container due to the collision of the automobile against an obstacle or the sharp braking of the automobile or while the automobile is traveling on a rough road, the locking weight 9 slides downward by inertia to its lowermost position against the resilience of the compression coil spring 11 as shown in FIGS. 3 and 6. Consequently, the head of the locking weight 9 is positioned on the path of the locking projection 6 of the support leg 4 and the head of the locking weight 9 comes into contact with the locking projection 6 of the support leg 4, whereby the swing lid 2 is prevented from turning in the closing direction. Since the swing lid 2 cannot be turned in the closing direction by the shocks, the lid locking projection d cannot be released from the latch e. When the shocks are removed from the container, the locking weight 9 is returned to its uppermost position by the resilience of the compression coil spring 11 to allow the swing lid 2 to be freely opened and closed.

Thus, the swing lid locking mechanism in this embodiment locks the support leg 4 pivotally supporting the swing lid 2 on the container body 1 when shocks act on the container, and is formed near the pivot pin 5 on which the swing lid 2 swings. Therefore, the swing lid locking mechanism can be properly used when the structural requirements of the automobile require requires the swing lid locking mechanism to be installed on the side of the support pin 5. Since none of the component parts of the swing lid locking mechanism is exposed in the open end of the container body 1 of the container, the swing lid locking mechanism does not spoil the aesthetic appearance of the container when the swing lid 2 is opened.

Although the swing lid locking mechanism of the present invention has been described as applied to a container provided with a push-lock/push-unlock latch, the swing lid locking mechanism of the present invention is properly applicable also to a container not provided with any push-lock/push-unlock latch because the swing lid locking mechanism locks the swing lid 2 by bringing the locking weight 9 into direct contact with the locking projection 6 of the support leg 4 formed near the support pin 5. When the container is not provided with the latch e, and the swing lid is biased in a closing direction when the swing lid 2 is near the closed position to hold the swing lid 2 at the closed position and biased in the opening direction when the swing lid 2 is near the open position to hold the swing lid 2 at the open position, it is possible to prevent the swing lid 2 from turning in the opening direction when shocks act on the container by disposing the impact locking device 7 on the front side of the locking projection 6 to prevent the turning of the support leg 4 in the opening direction by the locking weight 9.

Although the swing lid locking mechanism in this embodiment is formed so as to lock the swing lid 2 at the closed position when shocks act on the container, the swing lid locking mechanism may be formed so as to lock the swing lid 2 at a desired angular position by the engagement of the locking projection 6 and the locking weight 9 by properly determining the position of the locking projection 6 on the support leg 4. Thus, the swing lid 2 can be locked at either the closed position or the open position. Furthermore, the support leg 4 may be provided with two locking projections, namely, a locking projection for locking the swing lid 2 at the closed position and a locking projection for locking the swing lid 2 at the open position to enable the swing lid 2 to be locked at both the closed position and the open position when shocks act on the container. The swing lid locking mechanism can be formed so as to lock the swing lid 2 at both the closed position and the open position by providing the support leg 4 with an additional locking projection that is positioned on the front side of the locking weight 9 when the swing lid 2 is at the open position. When shocks act on the container with the swing lid 2 at the open position, the turning of the support leg 4, hence the swing lid 2, is prevented by the engagement of the additional locking projection and the locking weight 9 to hold the swing lid 2 securely at the open position.

Although the present invention has been described in its preferred form with a certain degree of particularity, obviously many changes and variations are possible therein. It is to be understood that the present invention may be practiced otherwise than as specifically described herein without departing from the scope and spirit thereof.

I claim:

1. A swing lid locking mechanism comprising a swing lid having a body which is swingably supported at an open end by swingably connecting support legs projecting from the lid body thereof to the container; stopping projections formed on the support legs of the swing lid; a locking weight slidably supported on the container at a position near the support leg; and a biasing means for biasing the locking weight in one sliding direction;

characterized in that the locking weight slides by inertia against the biasing force of the biasing means when shocked and comes into engagement with the stopping projection to stop the swing motion of the support leg to prevent the swing lid from turning in order that the swing lid is prevented from opening or closing when shocked.

2. A swing lid locking mechanism according to claim 1, wherein the swing lid is biased in the opening direction, a locking projection is disposed on the lower surface of the free end of the swing lid, a push-lock-push-unlock latch that engages with the locking projection is provided on the container to lock the swing lid in a closed position against the biasing force by latching the locking projection by the push-lock-push-unlock latch, the locking projection is unlocked by turning the swing lid in a closing direction from the closed position to push the locking projection into the latch, and the swing lid is turned in an opening direction by the biasing force to open the swing lid.

3. A swing lid locking mechanism according to claim 1, wherein the locking weight is provided with a groove in a portion thereof and is supported slidably on the container, the locking weight is biased in one sliding direction, the stopping projection of the support leg of the swing lid is able to pass through the groove of the locking weight so that the swing lid is able to turn freely in the normal state, the locking weight slides by inertia against the biasing force when shocked and comes into engagement with the stopping projection to stop the swing motion of the support leg in order that the turning of the swing lid is stopped to prevent the swing lid from opening or closing when shocked.

4. A swing lid locking mechanism according to claim 2, wherein the locking weight is provide with a groove in a portion thereof and is supported slidably on the container, the locking weight is biased in one sliding direction, the locking weight is disposed near the stopping projection of the support leg of the swing lid as held in an closed position on the side toward which the stopping projection moves when the swing lid turns in the closing direction, the stopping projection of the support leg of the swing lid is able to pass through the groove of the locking weight so that the swing lid is able to turn freely in the normal state, the locking weight slides by inertia against the biasing force when shocked and comes into engagement with the stopping projection to prevent the support leg from turning further from the closed position in the closing direction in order that the swing lid is unable to turn further from the closed position to release the locking projection from the latch.

* * * * *